US009669902B2

(12) United States Patent
Geislinger

(10) Patent No.: US 9,669,902 B2
(45) Date of Patent: Jun. 6, 2017

(54) HYDROFOIL

(71) Applicant: Ellergon Antriebstechnik Gesellschaft m.b.H., Hallwang (AT)

(72) Inventor: Cornelius Geislinger, Hallwang (AT)

(73) Assignee: Ellergon Antriebstechnik Gesellschaft M.B.H., Hallwang (AT)

( * ) Notice: Subject to any disclaimer, the term of this patent is extended or adjusted under 35 U.S.C. 154(b) by 30 days.

(21) Appl. No.: 14/615,894

(22) Filed: Feb. 6, 2015

(65) Prior Publication Data

US 2015/0225040 A1 Aug. 13, 2015

(30) Foreign Application Priority Data

Feb. 7, 2014 (DE) ..... 10 2014 101 536
Aug. 1, 2014 (DE) ..... 20 2014 103 591 U

(51) Int. Cl.

| | |
|---|---|
| ***B63B 1/26*** | (2006.01) |
| ***B63B 35/79*** | (2006.01) |
| ***B63B 1/24*** | (2006.01) |
| ***B63B 35/73*** | (2006.01) |

(52) U.S. Cl.

CPC ..... *B63B 1/242* (2013.01); *B63B 1/248* (2013.01); *B63B 1/26* (2013.01); *B63B 35/731* (2013.01); *B63B 35/7923* (2013.01); *B63B 35/7953* (2013.01); *B63B 35/793* (2013.01)

(58) Field of Classification Search

CPC ..... B63B 35/7923; B63B 1/242; B63B 1/248; B63B 35/7926

See application file for complete search history.

(56) References Cited

U.S. PATENT DOCUMENTS

| | | | | |
|---|---|---|---|---|
| 7,097,523 | B2 * | 8/2006 | Woolley | B63B 35/73 114/253 |
| 8,944,872 | B2 * | 2/2015 | Hill | B63B 35/7923 114/288 |
| 9,056,654 | B1 | 6/2015 | Fraser | |
| 2001/0010200 | A1 | 8/2001 | Woolley | |
| 2002/0115363 | A1 | 8/2002 | Murphy | |
| 2005/0090166 | A1 | 4/2005 | Woolley | |

(Continued)

FOREIGN PATENT DOCUMENTS

| | | | |
|---|---|---|---|
| FR | 2832692 | A1 | 5/2003 |

OTHER PUBLICATIONS

Flyer of Alpinefoil 4.5: Show Room KiteFoil (SurfKite 5.0); published Feb. 4, 2014, available online at www.alpinefoil.com.

(Continued)

*Primary Examiner* — Andrew Polay
(74) *Attorney, Agent, or Firm* — Myers Wolin, LLC

(57) ABSTRACT

A hydrofoil, suitable for kite surfing and jet skiing, comprises a keel fin having a first end portion for fastening to a board; and a front wing and a rear wing which are arranged one behind the other in the travel direction and are connected to a second end portion of the keel fin; wherein a connecting rod is situated on the second end portion of the keel fin and detachably connects the wings to the keel fin; and wherein a plate is situated on an outer side of the keel fin and on an outer side of at least one of the wings, and via detachable fastening means is braced to the connecting rod so as to detachably fasten at least one of the wings to the keel fin.

20 Claims, 5 Drawing Sheets

(56) References Cited

U.S. PATENT DOCUMENTS

| | | | |
|---|---|---|---|
| 2005/0255764 | A1 | 11/2005 | Woolley |
| 2005/0266746 | A1 | 12/2005 | Murphy |

OTHER PUBLICATIONS

German Search Report, dated Dec. 16, 2014, with English translation for German Application No. 10 2014 101 536.3.
European Search Report, dated Jul. 21, 2015, for European Application No. 15153672.9.
Australian Search Report, dated Aug. 13, 2015, for Australian Application No. 2015200394.
AHD Boards TV: "Hydrofoil: AFS-1 session ENG.mov", Apr. 6, 2012, XPO54975682, retrieved from https://www.youtube.com/watch?v=aihqiBahXsU on Aug. 5, 2016.

* cited by examiner

HYDROFOIL

CROSS REFERENCE TO RELATED APPLICATIONS

This application claims priority under 35 USC §119 to German Patent Application No. 10 2014 101 536.3, filed on Feb. 7, 2014, and German Utility Model Application No. 20 2014 103 591.5, filed on Aug. 1, 2014, the contents of each of which are incorporated herein by reference.

FIELD OF THE INVENTION

The invention relates to a hydrofoil.

BACKGROUND

Hydrofoils allow a board to lift out of the water during kite surfing or jet skiing in order to reduce the flow resistance. In the process, only a portion of the keel fin and the two wings remains submerged in the water.

Conventional hydrofoils have only limited adaptability to different purposes, and are bulky in their dimensions. In addition, the connecting area between the keel fin and the wings is subjected to strong stresses due to the forces which occur during operation.

SUMMARY

The object of the invention is to improve a hydrofoil in consideration of the above-mentioned aspects.

This object is achieved by a hydrofoil comprising a keel fin having a first end portion for fastening to a board, and a front wing and a rear wing which are arranged one behind the other in the travel direction and are connected to a second end portion of the keel fin, wherein a connecting rod is situated on the second end portion of the keel fin and detachably connects the wings to the keel fin, and wherein a plate is situated on an outer side of the keel fin and on an outer side of at least one of the wings, and via detachable fastening means is braced to the connecting rod so as to detachably fasten at least one of the wings to the keel fin.

Since the front wing is generally located closer to the keel fin, the front wing is typically fastened to the keel fin in the manner described above. However, it is also possible to correspondingly affix the rear wing or both wings to the keel fin.

Whereas the connecting rod is able to absorb the bending moments, the plate is used primarily for transmitting the torsional moments between the wing in question and the keel fin.

The wings and the connecting rod may be easily replaced, if necessary.

Due to such a modular design, it is possible in particular to influence the handling characteristics of the hydrofoil for different purposes via the selection of the length of the connecting rod, and via the shape of the front and rear wings by using different front and rear wings.

In addition, each individual component may be optimized from a materials technology standpoint, as the result of which, among other things, the strength properties and stiffness properties in the connecting area between the keel fin and the wings may be improved.

Since the connecting rod may be designed to be very narrow, the resistance in the water may be further reduced.

Furthermore, the hydrofoil may be folded up very compactly, which is advantageous in particular for airline travel.

A large-surface introduction of force is made possible via the plate, and allows large tension forces in the connection. Wear and settling effects may be counteracted by simply tightening the fastening means. This is advantageous in particular when the keel fin and/or the wings is/are made of fiber composite material. The screw threads are situated in the steel elements, resulting in a precise, wear-resistant connection.

The plate may be situated in a recess which extends along the second end portion of the keel fin and one or both wings. The transmission of torsional moments is further improved in this way. For this purpose, the plate is preferably accommodated in the recess in a positive-fit manner.

In addition, the recess may be formed as a groove in the second end portion on the keel side, as the result of which the plate is easily accessible for mounting and dismounting the wings and optionally also the connecting rod. However, a lateral arrangement is likewise possible.

With regard to a favorable flow profile, the plate may be integrated into the outer contour of the hydrofoil. For this purpose, the plate may continue the outer contour of the second end portion of the keel fin and of the wing in question in a continuous manner, i.e. without interruption. A particularly compact design is achieved by a uniformly planar connection of the elements.

According to another embodiment, the plate is made of metal, thus enabling high tension forces when the wings and a keel fin are made of fiber composite material, since the plate broadens the supporting base of the clamping connection at the interface with the fiber composite material. However, the plate may be made of a material selected from metal, fiber composite material or a combination thereof.

As fastening means, threaded bolts may be provided which are inserted from the outer side of the plate and screwed to the connecting rod. This arrangement is particularly advantageous for replacing the wings and the connecting rod. The thread and the screw support in a connecting rod, as well as a plate made of steel or some other metallic material, allow a particularly precise, wear-resistant connection.

The plate may have an elongated design, and extends predominantly in the travel direction of a kiteboard equipped with the hydrofoil. The plate may extend parallel to the connecting rod.

The connecting rod may be detachably fastened to the second end portion of the keel fin in the manner explained above. In addition, a detachable fastening of a wing to the connecting rod, in particular a detachable fastening of the front wing to a front end of the connecting rod, may be achieved. Furthermore, the rear wing may also be detachably fastened to a rear end of the connecting rod.

The keel fin at its second end portion preferably forms a receptacle for the connecting rod, thus achieving a particularly stable force bracing and torque bracing. In particular, the keel fin at its second end portion may form a receptacle in the form of a passage opening through which the connecting rod is passed.

The keel fin and optionally also the wings are preferably made of a fiber composite material.

In contrast, with regard to a compact and stable design, the connecting rod is preferably made of metal, in particular steel and titanium alloys and aluminum alloys being suitable here. However, the connecting rod may also be made of a fiber composite material or a combination of the mentioned materials. Metallic threaded sleeves may optionally be embedded in the fiber composite material for bracing to the plate.

According to another embodiment, a connecting rod having a constant diameter is used, which is easily manufactured in different lengths. In particular, the length of the connecting rod may be varied in a range of 400 to 900 mm.

Suitable diameters for the connecting rod are in the range of 10 to 25 mm.

According to yet another embodiment, the invention provides a hydrofoil, comprising: a keel fin having a first end portion for fastening to a board; and a front wing and a rear wing which are arranged one behind the other in the travel direction and are connected to a second end portion of the keel fin; wherein a connecting rod is situated on the second end portion of the keel fin and detachably connects the wings to the keel fin; wherein a plate is situated on an outer side of the keel fin and on an outer side of at least one of the wings, and via detachable fastening means is braced to the connecting rod so as to detachably fasten at least one of the wings to the keel fin; wherein the keel fin at its second end portion forms a receptacle for the connecting rod; wherein the plate is arranged in a recess formed on the second end portion of the keel fin; and at least one bolt for jointly securing the plate and connecting rod at the second end portion of the keel fin.

According to yet another embodiment, the invention provides a board having a hydrofoil, said hydrofoil comprising: a keel fin having a first end portion for fastening to a board; and a front wing and a rear wing which are arranged one behind the other in the travel direction and are connected to a second end portion of the keel fin; wherein a connecting rod is situated on the second end portion of the keel fin and detachably connects the wings to the keel fin, and wherein a plate is situated on an outer side of the keel fin and on an outer side of at least one of the wings, and via detachable fastening means is braced to the connecting rod so as to detachably fasten at least one of the wings to the keel fin.

BRIEF DESCRIPTION OF THE DRAWINGS

The invention is explained in greater detail below with reference to exemplary embodiments illustrated in the drawings, which show the following.

DETAILED DESCRIPTION OF THE PREFERRED EMBODIMENTS

Figure 1:
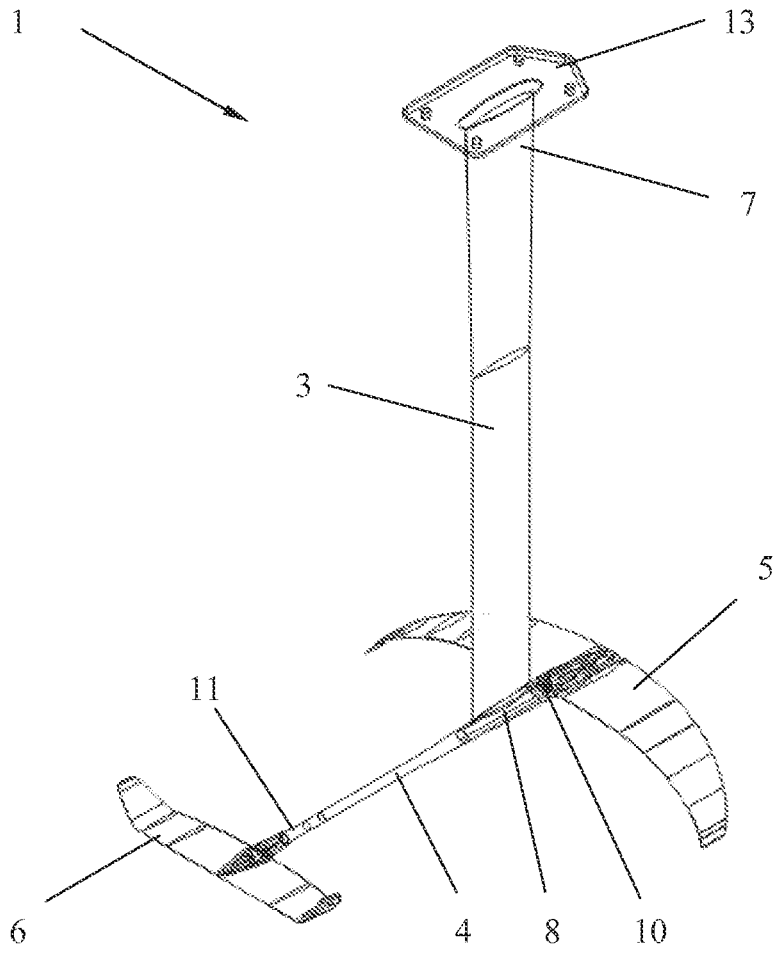
FIG. 1 shows a three-dimensional view of a hydrofoil according to a first exemplary embodiment of the invention.
Figure 2:
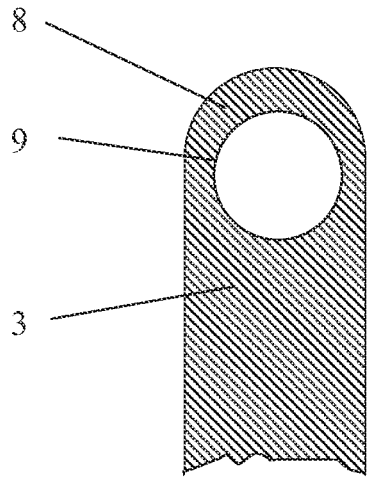
FIG. 2 shows a detailed view of the second end portion of the keel fin.
Figure 3:
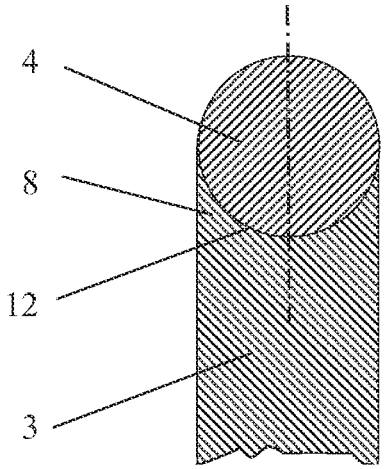
FIG. 3 shows a detailed view of a modification of the second end portion.
Figure 7:
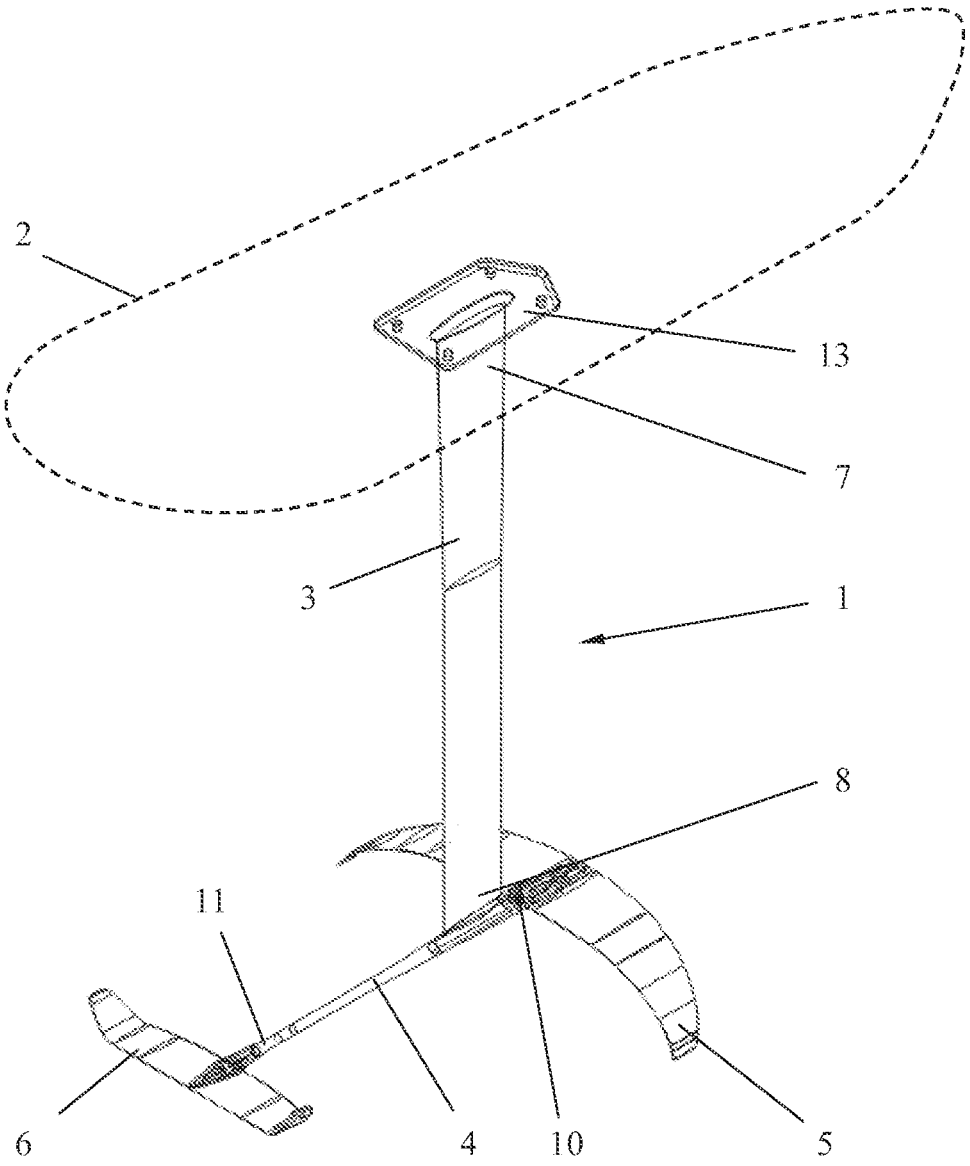
FIG. 7 shows one exemplary embodiment of a board having a hydrofoil.

The exemplary embodiment in FIG. 1 shows a hydrofoil 1 for fastening to a board 2 (see FIG. 7) which is suitable for kite surfing and jet skiing.

The hydrofoil 1 comprises a keel fin 3, a connecting rod 4, a front wing 5, and a rear wing 6. These components are connected to one another via standardized interfaces, so that they may be individually replaced. This results in a modular system which allows a flexible adaptation to different purposes.

The keel fin 3 has a first end portion 7 for fastening to the board 2, and a second end portion 8 for joining the connecting rod 4. The keel fin preferably has a height of approximately 700 to 1000 mm, a thickness of approximately 10 to 30 mm, and a length of approximately 80 to 150 mm in the travel direction. The keel fin 3 is made, for example, of a fiber composite material such as carbon fiber-reinforced plastic (CFRP) or glass fiber-reinforced plastic (GFRP). However, it may also be made of an aluminum alloy or a laminated composite material.

The first end portion 7 may form a flange-like fastening portion 13 which forms a support surface 2 for the bottom side of the board which is larger than the remaining cross section of the keel fin 3.

The second end portion 8 of the keel fin 3 has a receptacle in the form of a passage opening 9 through which the connecting rod 4 may be passed. Instead of a passage opening 9, the receptacle may be designed as a recess that is open on one longitudinal side, in particular as a groove 12 in which the connecting rod 4 is fixed.

The front wing 5 and the rear wing 6 are fastened to the keel fin 3 via the connecting rod 4. During surfing, forces which occur at the wings 5 and 6 are supported against the keel fin 3 via the connecting rod 4 in the passage opening 9. The connecting rod 4 is prevented from rotating about its longitudinal axis A at the keel fin 3. This may be achieved, for example, by appropriate profiling of the connecting rod 4 and the passage opening 9, or with the aid of suitable fastening means.

Figure 4:
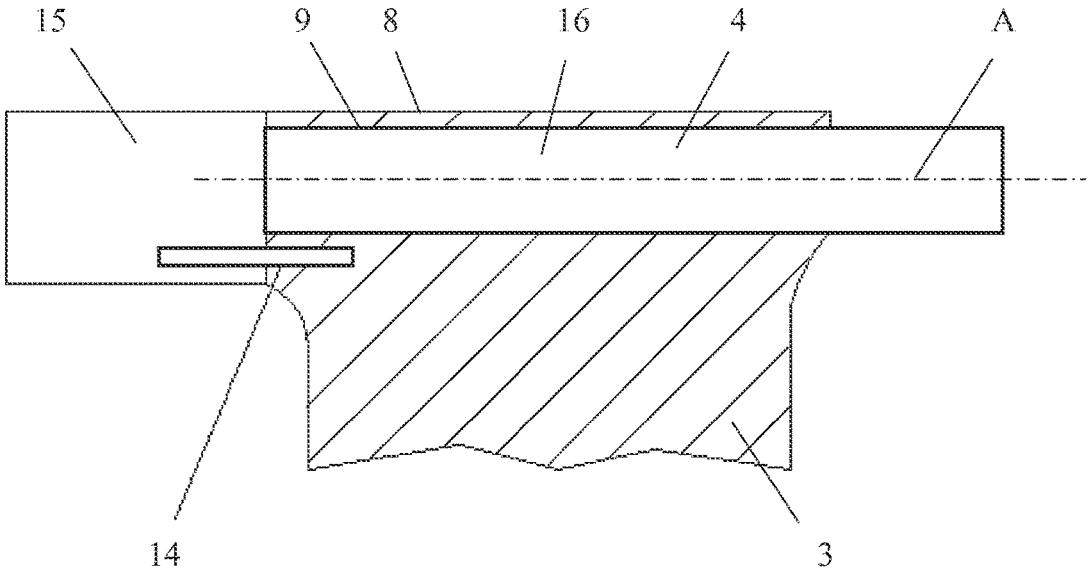
FIG. 4 shows a first variant for preventing rotation of the connecting rod.

In one shape of the connecting rod 4 having a circular cross section, the connecting rod 4 may be prevented from rotating by means of an additional longitudinal pin 14, for example, as illustrated in FIG. 4. For this purpose a head 15 is integrally formed on or fastened to the connecting rod 4, the head being axially supported against the second end portion 8 of the keel fin 3. The longitudinal pin 14 extends from the head 15 into the end portion 8, so that both parts are unambiguously positioned with respect to one another. The longitudinal pin is radially offset with respect to the longitudinal axis A of the portion 16 of the connecting rod 4 which extends through the passage opening 9, and may run parallel to the longitudinal axis A. The longitudinal pin 14 may also be designed as an elongated plate. The latter may also be screwed onto the hydrofoil 1 on the outer side. One of the wings 5 or 6 may be detachably fastened to the head 15. In addition, it is possible to integrate the head 15 into one of the wings 5 or 6, so that the anti-rotation protection for the connecting rod 4, which is detachably connected to the wing in question, takes place by providing that particular wing in between.

Figure 5:
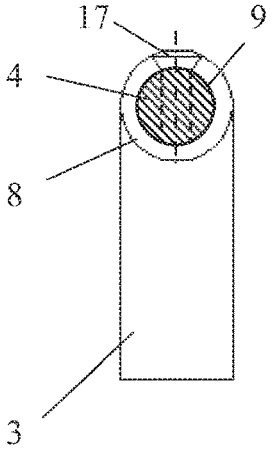
FIG. 5 shows a second variant for preventing rotation.

In addition, the connecting rod 4 may be prevented from rotating by means of a bolt 17 or pin which extends into the end portion 8 and into the connecting rod 4, transversely with respect to the longitudinal axis A, as illustrated in FIG. 5.

Figure 6:
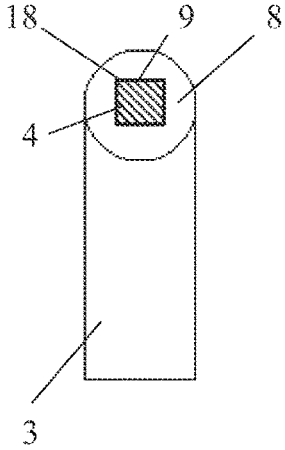
FIG. 6 shows a third variant for preventing rotation.

Another alternative is to use a connecting rod 4 having a square profile 18, as illustrated in FIG. 6.

The connecting rod 4 is made of metal, preferably a steel or a titanium or aluminum alloy. The connecting rod has a diameter in the range of 10 to 25 mm, as the result of which the flow resistance in water remains low. The length of the connecting rod 4 is preferably in the range of 400 to 900 mm.

With regard to simple manufacture and installation, the connecting rod 4 may be designed with a constant diameter. However, it is also possible for only portions, such as the area which is guided in the passage opening 9 or groove 12, to be designed with a constant cross section.

The front wing 5 and the rear wing 6 are arranged one behind the other in the travel direction, and are detachably fastened to the respective ends of the connecting rod 4. In particular, the front wing 5 is situated at a front end 10, and the rear wing 6 is situated at a rear end 11, of the connecting rod 4, so that the front wing 5 is positioned in front of the keel fin 3 and the rear wing 6 is positioned behind the keel fin 3.

The fastening of the connecting rod 4 to the keel fin 3 as well as the fastening of the wings 5 and 6 to the connecting rod 4 in each case have a detachable design. As a result, connecting rods 4 of different lengths may be fastened to the keel fin 3 in order to change the position of the wings 5 and 6. In addition, different front and rear wings 5 and 6 may be fastened to the connecting rod 4.

The wings 5 and 6 may be made of fiber composite material, in particular carbon fiber-reinforced plastic (CFRP) or glass fiber-reinforced plastic (GFRP), or a laminated composite material.

For assembly of the hydrofoil 1, initially a connecting rod 4 having the desired length may be mounted on the keel fin 3 by inserting the connecting rod through the passage opening 9. The desired wings 5 and 6 are subsequently fastened to the connecting rod 4. If the receptacle on the keel fin 3 is designed as an open groove 12, it is also possible to initially attach the two wings 5 and 6 to the connecting rod 4, and then mount the entire unit on the keel fin 3.

The hydrofoil 1 may be disassembled very easily, for example to change the handling characteristics of the board 2 thus equipped, by exchanging the connecting rod 4 and/or the wings 5 and 6, and optionally also the keel fin 3.

Due to the modular design, a modular system is also made possible which easily allows a variety of boards 2 to be equipped with a foil 1.

Within the scope of a modular system, it is also possible to configure the connecting rod together with one of the wings as a unit. In this case, the wing in question and the connecting rod would then always have to be mounted and dismounted together. For this purpose, for example, the front wing together with the connecting rod may be produced as an integral component made of fiber composite material. Any required threads may be provided by embedding appropriate sleeves or the like made of metal.

The foil 1 may also be folded up very compactly for transport.

Figure 8:
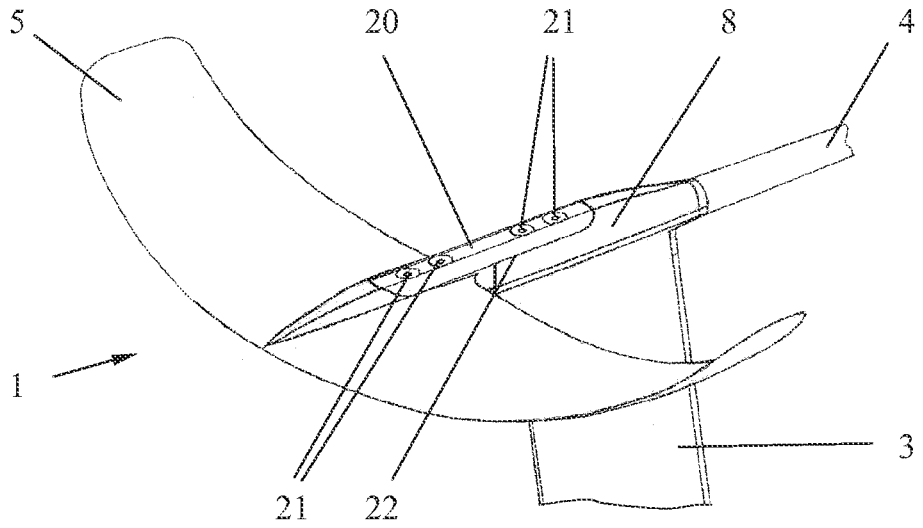
FIG. 8 shows a three-dimensional detailed view of a hydrofoil according to a second exemplary embodiment of the invention.
Figure 9:
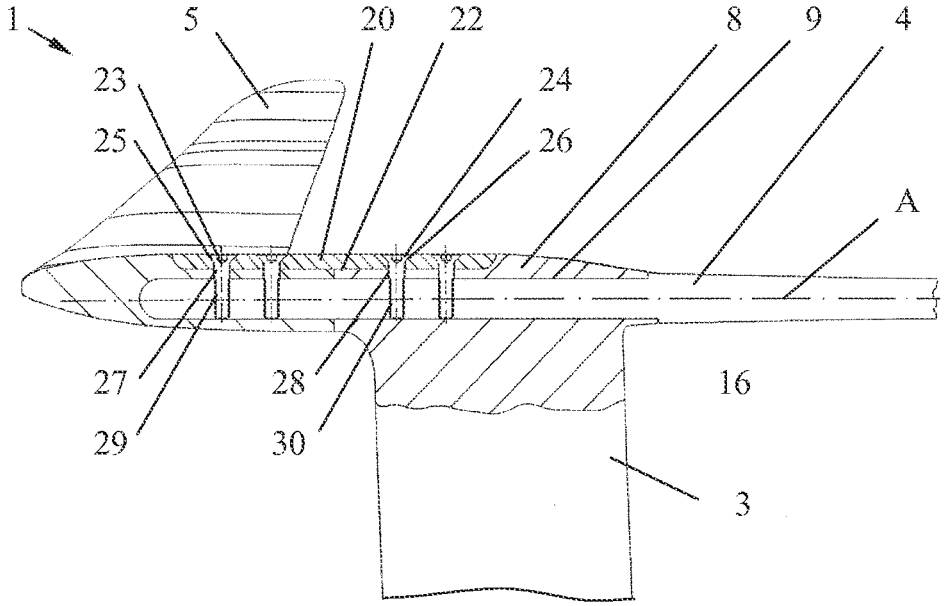
FIG. 9 shows a longitudinal section of the area of connection of a wing to the keel fin.

FIGS. 8 and 9 illustrate a second exemplary embodiment which differs from the first exemplary embodiment by virtue of the area of connection of the front wing 5 to the keel fin 3. These differences are explained in greater detail below. In other respects, the second exemplary embodiment corresponds to the first exemplary embodiment.

The hydrofoil 1 of the second exemplary embodiment has a connecting rod 4 which, the same as in the first exemplary embodiment, is situated on the second end portion 8 of the keel fin 3 and detachably connects the wings 5 and 6 to the keel fin 3.

The connecting rod 4 extends through a passage opening 9 provided in the keel fin 3, while the wings 5 and 6 are fastened to the ends 10 and 11, respectively, of the connecting rod. With regard to simple manufacture, the connecting rod 4 is designed with a circular cross section. However, other cross section profiles are also possible, as already explained above.

For fastening the front wing 5, a plate 20 is additionally provided which is situated on an outer side of the keel fin 3 and on an outer side of the front wing 5, and which thus partially overlaps both components 3, 5. The plate 20 is braced to the connecting rod 4 by detachable fastening means 21 in order to detachably fasten the front wing 5 to the keel fin 3. The end portion 8 of the keel fin 3 and the wing in question are positioned relative to one another via the plate 20, so that a longitudinal pin 14 according to FIG. 4 inside the components may possibly also be dispensed with.

It is also possible to fasten the rear wing 6 to the keel fin 3 in a corresponding manner. In addition, both wings 5 and 6 may be detachably fastened to the keel fin 3 via a shared plate 20 or via their own plate 20. For this purpose, the particular plate 20 is braced against the connecting rod 4.

The bracing preferably takes place transversely with respect to the longitudinal direction of extension A of the connecting rod 4.

In the illustrated exemplary embodiment, the plate 20, which may have an elongated design in the travel direction and preferably runs parallel to the connecting rod 4, is mounted on the keel side. However, fastening on the side of the hydrofoil 1 is also possible.

For accommodating the plate 20, a recess 22 is provided on the keel fin 3, and may continue into the wing 5 in question. The recess 22 preferably extends along the second end portion 8 of the keel fin 3 and along at least one of the two wings 5 and 6.

In the illustrated exemplary embodiment, the plate 20 is accommodated in the recess 22 in such a way that the plate continues the outer contour of the second end portion 8 and of the wing 5 or 6 in question without interruption. In addition, the plate 20 may be accommodated in the recess 22 in a positive-fit manner.

The plate 20 as well as the connecting rod 4 are made of metal, whereas the keel fin 3 and the wings 5 and 6 are preferably made of a fiber composite material. As fastening means 21, threaded bolts may be used which are inserted from the outer side of the plate 20 and screwed to the connecting rod 4.

In the illustrated exemplary embodiment according to FIGS. 8 and 9, two threaded bolts 23 are provided for detachably fastening the front wing 5 to the front end 10 of the connecting rod 4, and two additional threaded bolts 24 are provided for detachably fastening the keel fin 3 to the portion 16 of the connecting rod 4 which extends through the passage opening 9. The plate 20 has corresponding boreholes 25 and 26. Similarly, openings 27 and 28 which extend transversely with respect to the connecting rod 4 are provided on the front wing 5 and on the keel fin 3, respectively. Corresponding threaded openings 29 and 30 into which the threaded bolts 23 and 24, respectively, are screwed are provided on the connecting rod 4. However, the number of threaded bolts 23 and 24 may also be selected to be smaller or greater if necessary. Other fastening means may also be used instead of threaded bolt 23 and 24. For example, quick-clamping devices which may be tightened and/or loosened by hand without an additional tool are possible.

In the fastening concept explained above, the connecting rod 4 is able to absorb the bending moments, while the plate 20 is used primarily for transmitting the torsional moments.

A large-surface, positive-fit introduction of force allows the keel fin 3 and the wings 5 and 6 to be made of a fiber composite material, while a metallic plate 20 in conjunction with the connecting rod 4 allows a stable, precise, and wear-resistant connection of the modular system. In addition, a compact, streamlined design is achieved by a uniformly planar connection of the elements.

Wear and settling effects in the fiber composite material may be easily eliminated by retightening the fastening means 21.

The invention has been explained in greater detail above with reference to exemplary embodiments. However, the invention is not limited thereto; rather, it encompasses all embodiments defined by the claims. In particular, individual technical features may also be combined with one another, even if this is not expressly described, provided that such a combination is technically possible.

What is claimed is:

1. A hydrofoil, comprising:

a keel fin having a first end portion for fastening to a board; and a front wing and a rear wing which are arranged one behind the other in the travel direction and are connected to a second end portion of the keel fin;

wherein a connecting rod is situated on the second end portion of the keel fin and detachably connects the wings to the keel fin;

wherein a plate is situated on an outer side of the keel fin and on an outer side of at least one of the wings, and partially overlaps the keel fin and said at least one wing to transmit torsional moments between the keel fin and the at least one wing, and wherein the plate is braced to the connecting rod by detachable fastening means to thereby detachably fasten at least one of the wings to the keel fin.

2. The hydrofoil of claim 1, wherein the plate is situated in a recess which extends along the second end portion and one or both wings.

3. The hydrofoil of claim 2, wherein the plate is accommodated in the recess in a positive-fit manner.

4. The hydrofoil of claim 2, wherein the recess is formed as a groove in the second end portion on the keel side.

5. The hydrofoil of claim 1, wherein the plate continues an outer contour of the second end portion and of the corresponding wing in a continuous manner.

6. The hydrofoil of claim 1, wherein the plate is made of material selected from metal, fiber composite material or a combination thereof.

7. The hydrofoil of claim 1, wherein as fastening means, threaded bolts are provided which are inserted from the outer side of the plate and screwed to the connecting rod.

8. The hydrofoil of claim 1, wherein the plate has a rod-shaped design and extends in the travel direction.

9. The hydrofoil of claim 1, wherein the plate extends parallel to the connecting rod.

10. The hydrofoil of claim 1, wherein the connecting rod extends in the travel direction and is detachably fastened to the second end portion of the keel fin;

the front wing is detachably fastened to a front end of the connecting rod; and the rear wing is detachably fastened to a rear end of the connecting rod.

11. The hydrofoil of claim 10, wherein the keel fin at its second end portion forms a receptacle for the connecting rod.

12. The hydrofoil of claim 11, wherein the keel fin at its second end portion forms a passage opening as a receptacle, through which the connecting rod is passed.

13. The hydrofoil of claim 11, wherein the keel fin at its second end portion forms a groove that is open on one longitudinal side as a receptacle, in which the connecting rod engages.

14. The hydrofoil of claim 1, wherein the keel fin is made of a fiber composite material.

15. The hydrofoil of claim 1, wherein the connecting rod is made of metal.

16. The hydrofoil of claim 1, wherein the connecting rod is made of a material selected from steel, titanium alloy, aluminum alloy, fiber composite material or a combination thereof.

17. The hydrofoil of claim 1, wherein the connecting rod has a constant diameter.

18. The hydrofoil of claim 1, wherein the connecting rod has a diameter in the range of 10 to 25 mm and/or a length of 400 to 900 mm.

19. A hydrofoil, comprising:

a keel fin having a first end portion for fastening to a board; and a front wing and a rear wing which are arranged one behind the other in the travel direction and are connected to a second end portion of the keel fin;

wherein a connecting rod is situated on the second end portion of the keel fin and detachably connects the wings to the keel fin;

wherein a plate is situated on an outer side of the keel fin and on an outer side of at least one of the wings, and via detachable fastening means is braced to the connecting rod so as to detachably fasten at least one of the wings to the keel fin;

wherein the keel fin at its second end portion forms a receptacle for the connecting rod;

wherein the plate is arranged in a recess formed on the second end portion of the keel fin; and at least one bolt for jointly securing the plate and connecting rod at the second end portion of the keel fin.

20. A board having a hydrofoil, said hydrofoil comprising:

a keel fin having a first end portion for fastening to a board; and a front wing and a rear wing which are arranged one behind the other in the travel direction and are connected to a second end portion of the keel fin;

wherein a plate is situated on an outer side of the keel fin and on an outer side of at least one of the wings and partially overlaps the keep fin and the at least one wing to transmit torsional moments between the keel fin and the at least one wing, wherein the plate is braced to the connecting rod by detachable fastening means so as to detachably fasten at least one of the wings to the keel fin.

* * * * *